US007762784B2

(12) United States Patent
Propheter-Hinckley

(10) Patent No.: US 7,762,784 B2
(45) Date of Patent: Jul. 27, 2010

(54) INSERTABLE IMPINGEMENT RIB

(75) Inventor: Tracy A. Propheter-Hinckley, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 359 days.

(21) Appl. No.: 11/652,434

(22) Filed: Jan. 11, 2007

(65) Prior Publication Data

US 2008/0170944 A1 Jul. 17, 2008

(51) Int. Cl.
*F04D 29/38* (2006.01)

(52) U.S. Cl. ..... 416/224; 415/115; 416/97 R

(58) Field of Classification Search ..... 415/115; 416/96 A, 97 R, 95, 224
See application file for complete search history.

(56) References Cited

U.S. PATENT DOCUMENTS 3,369,792 A * 2/1968 Kraimer et al. ..... 415/115
3,715,170 A * 2/1973 Savage et al. ..... 416/97 R
4,063,851 A * 12/1977 Weldon ..... 416/97 A
4,257,734 A * 3/1981 Guy et al. ..... 415/115
5,669,759 A * 9/1997 Beabout ..... 416/97 R
6,318,963 B1 * 11/2001 Emery et al. ..... 416/96 A
6,572,329 B2 * 6/2003 Tiemann ..... 415/115

* cited by examiner

*Primary Examiner*—Igor Kershteyn
(74) *Attorney, Agent, or Firm*—Carlson, Gaskey & Olds PC

(57) ABSTRACT

An insertable impingement rib assembly inside of a turbine vane. The turbine vane has an airfoil portion with a leading edge and a trailing edge. The turbine vane has an inner diameter platform and an outer diameter platform. A guide channel is located in the airfoil portion of the turbine vane. The guide channel has an insertion point, a leading edge guide rail rib, a trailing edge guide rail rib, and a plurality of apertures therethrough. An impingement rib is insertable into the guide channel.

22 Claims, 4 Drawing Sheets

INSERTABLE IMPINGEMENT RIB

BACKGROUND OF THE INVENTION

1. Field of the Invention

The present disclosure relates to gas turbine engine vanes. More specifically, the present disclosure relates to an insertable impingement rib assembly used for cooling gas turbine engine vanes.

2. Description of Related Art

Gas turbine engine vanes are used within the hot gas stream to direct the stream onto the rotating blades of the engine from which power is extracted. The conventional process used to fabricate a turbine vane is to cast the part. While the casting process yields a high quality product, it is costly and time consuming. The airfoil portion of the turbine vane is prone to overheating because of the extremely high temperatures that it is exposed to and making repairs to damaged airfoils can be expensive and impractical. Presently, it is not conveniently possible to adjust the amount of air flow being supplied to some of the impingement rib feed cavities by way of airfoil cooling passages without expending great amounts of time and money. Turbine vanes must be cooled to maintain structural integrity and one effective method of cooling is impingement cooling.

Turbine airfoils have ribs that are integrated, or permanently cast into the turbine vane casting configuration. The impingement ribs have crossovers that form impingement holes. Cooling air is provided to flow through the impingement holes in the impingement rib. The impingement rib functions as a cooling mechanism to tailor and/or tune the air flow through the turbine vanes. The impingement holes function to pressurize the air flowing behind them so that the air traveling through the holes is cooler.

Conventional turbine vane casting configurations are such that accurate hole sizing at the start of the casting process is of great importance. Once the core cylinders are leached out, fixed holes that are a product of the die remain. Impingement holes must be sized before the casting process commences and any holes that are sized improperly can adversely affect the life of the part. Current technology and casting tools makes the modification of impingement hole sizes laborious, difficult and time consuming because any necessary changes to hole sizes requires the casting tools to be modified. Additionally, the casting of impingement holes may result in substantial scrap, which leads to lost time and higher costs.

A further problem with the current casting configuration of a turbine vane is timing. As development programs are forced into shorter schedules, minimal time is allowed for engineering iterations that affect the casting of turbine vanes. This is because the lead-time associated with the creation of casting tools is fixed. The current casting configuration is also flawed in that the lifetime of the parts is sacrificed if impingement holes are sized improperly.

Accordingly, there is a need for a casting configuration of a turbine vane that provides flexibility to adapt to changing conditions and removes upstream guesswork. There is a further need for a universal casting that can receive an easily alterable and easily created insertable impingement rib upon assembly that will be more cost effective and will increase the lifetime of the turbine vane and its components.

SUMMARY OF THE INVENTION

An insertable impingement rib assembly for use inside of a turbine vane provides these and other objects of the present disclosure. The turbine vane has an airfoil portion with a leading edge and a trailing edge. The turbine vane has an inner diameter platform and an outer diameter platform. A guide channel is located in the airfoil portion of the turbine vane. The guide channel has an insertion point, a leading edge guide rail rib, a trailing edge guide rail rib, and a plurality of apertures therethrough. An impingement rib is insertable into the guide channel.

The above-described and other features and advantages of the present disclosure will be appreciated and understood by those skilled in the art from the following detailed description, drawings, and appended claims.

DETAILED DESCRIPTION OF THE INVENTION

Figure 1:
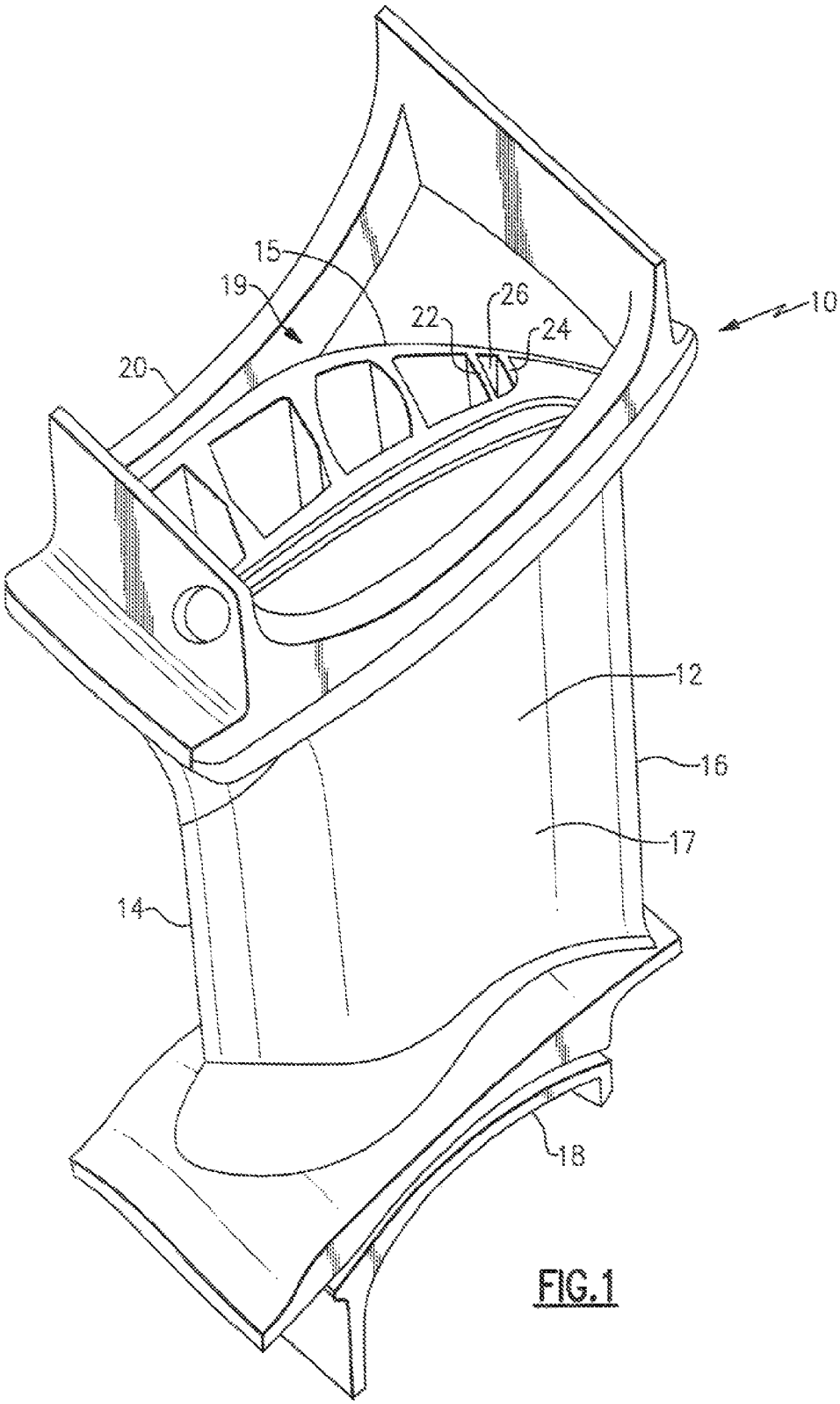
FIG. 1 illustrates an isometric view of the turbine vane casting configuration according to the present disclosure.

Referring now to the drawings and in particular to FIG. 1, the casting configuration of a turbine vane generally referred to by reference number 10 is shown. Turbine vane 10 has an airfoil portion 12 that includes an airfoil leading edge (LE) 14 and an airfoil trailing edge (TE) 16. Turbine vane 10 has an inner diameter (ID) platform 18 on one end and an outer diameter (OD) platform 20 on an opposite end. Airfoil portion 12 has a LE guide rail rib 22 and a TE guide rail rib 24. LE guide rail rib 22 and TE guide rail rib 24 form an insertable impingement rib guide channel 26. Turbine vane 10 has a suction side wall 15 and a pressure side wall 17 that cooperate to establish a cavity 19. LE guide rail rib 22 and TE guide rail rib 24 each span the cavity 19.

Advantageously, turbine vane 10 does not involve large features leading to small features and then back to large features, which is common in traditional casting configurations. The configuration of turbine vane 10 allows for faster and less expensive turnaround during an engine development program because impingement holes are no longer permanently cast into place. Instead, impingement holes can be resized outside of the airfoil casting so that modifications made to impingement hole sizes is less time consuming, more cost effective, and increases the lifetime of turbine vane parts.

Figure 2:
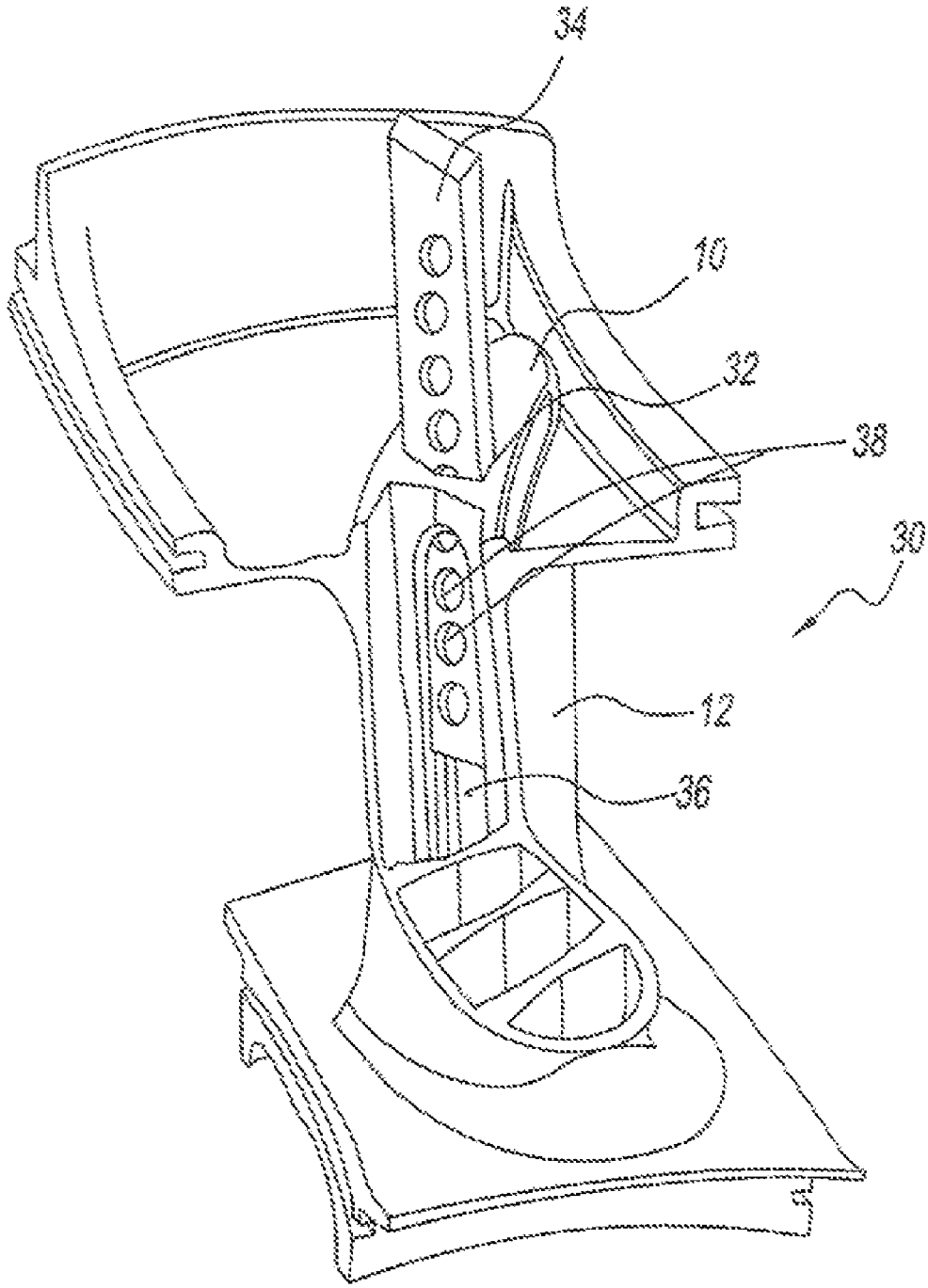
FIG. 2 is a cut-away view of the turbine vane casting configuration illustrating a partial assembly of the insertable impingement rib in an impingement rib guide channel according to the present disclosure.

Referring now to FIG. 2, a partial assembly of an insertable impingement rib in a guide channel of a turbine vane casting configuration according to the present disclosure is shown, generally referred to by reference number 30. Impingement rib assembly 30 has an impingement rib guide channel 32 and an insertable impingement rib 34. Guide channel 32 has a large aperture 36 therethrough. Impingement rib 34 is receivable through guide channel 32 where it can be assembled.

Impingement rib 34 can be machined of sheet metal or simply cast. The rib is machined or cast separately from the casting of turbine vane 10 and then inserted into guide channel 32. Impingement rib 34 has a plurality of impingement holes 38 that can be sized by machining just prior to final assembly or cast-in. When impingement rib 34 is inserted into guide channel 32, impingement holes 38 are in registration with the large aperture 36 in guide channel 32. Impingement rib 34 depicts a TE impingement rib, however the same configuration can be used to replace any impingement rib in the airfoil.

The impingement rib assembly 30 provides a universal casting that can receive an easily alterable and easily created insertable impingement rib 34 upon assembly. The insertable impingement rib 34 allows impingement hole sizes to be changed quickly and more efficiently without having to modify the core of turbine vane 10 by discarding inadequate ribs and replacing them in guide channel 32 with a new rib. The likelihood of core breakage is reduced because of the thicker core associated with aperture 36. Additionally, impingement rib assembly 30 provides closer control over the air flow through impingement ribs and allows for more precise tailoring of the impingement air flow during engine development programs.

Once insertable impingement rib 34 is assembled into guide channel 32, the guide channel insertion point is sealed and impingement rib 34 can be brazed into place or it can float freely to allow for pressurized sealing against one of the guide rail ribs. There may be a tab 37 (FIG. 2A) at the ID or at the OD insertion point if the shape of turbine vane 10 allows. If there is no tab the impingement rib 34 can be pushed all the way into guide channel 32 and the insertion hole can be welded closed or capped off by sheet metal or other means.

Given the extended length along the airfoil without full ribs, bulging may result when airfoil portion 12 is pressurized. Impingement rib assembly 30 can have pedestals in neighboring cavities to mitigate bulging. Alternatively, intermittent openings in the guide ribs can be created that tie the rib walls together more frequently along the length of the passages to alleviate bulging. This would require that the holes in insertable impingement rib 34 mirror that intermittence.

Figure 2A:
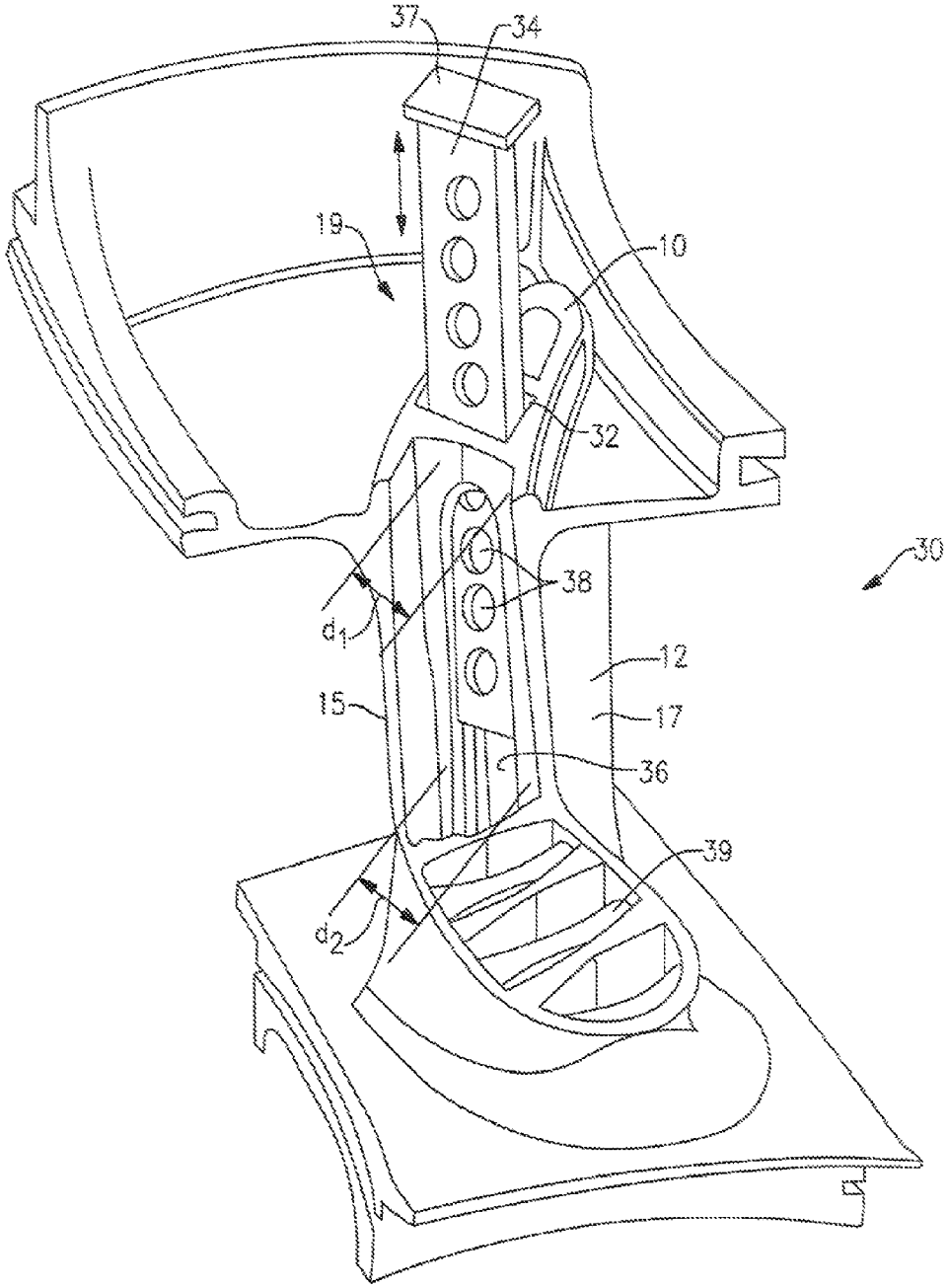
FIG. 2A is a cut-away view of the turbine vane casting configuration illustrating a partial assembly of another example insertable impingement rib in an impingement rib guide channel according to the present disclosure.

The intersection of the cast-to-sheet metal surfaces in guide channel 32 may cause leakage around the sides of insertable impingement rib 34. To alleviate potential leakage, the impingement rib 34 can be pressurized against one of the guide rail ribs during engine running condition. The rib could also be brazed into place to prevent leakage or the material selected to create the impingement rib 34 could be one that expands at a greater rate than the surrounding vane casting at engine running temperatures. Another solution could be to press fit impingement rib 34 into place by use of a tapered profile. Referring to FIG. 2A, a dimension $d_1$ of the guide channel 32 near the OD platform 20 is greater than a dimension $d_2$ of the guide channel 32 near the ID platform 18. The example guide channel 32 tapers from the OD to the ID of the turbine vane 10.

Figure 3:
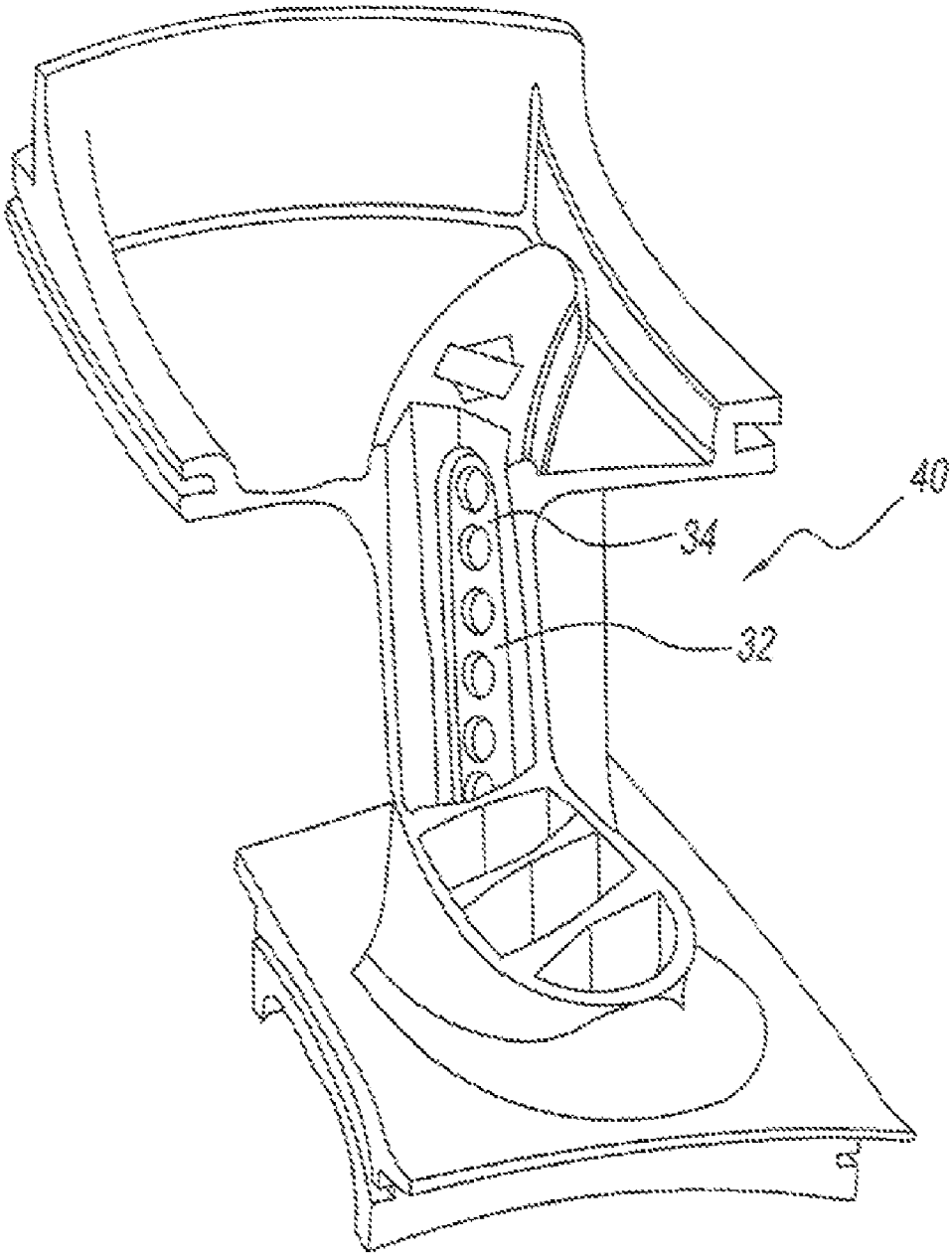
FIG. 3 is a cut-away view of the turbine vane casting configuration illustrating a fully assembled insertable impingement rib according to the present disclosure.

Referring now to FIG. 3, a fully assembled insertable impingement rib according to the present disclosure is shown, generally referred to by reference number 40. Insertable impingement rib 34 is pushed all the way into guide channel 32 of the turbine vane casting configuration.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. An insertable impingement rib assembly which comprises:

a turbine vane;

an airfoil portion of said turbine vane having a suction side wall and a pressure side wall that extend between a leading edge and a trailing edge, and an inner diameter platform and an outer diameter platform, the suction side wall and the pressure side wall cooperating to establish a cavity;

a guide channel in said airfoil portion having an insertion point, a leading edge guide rail rib spanning the cavity, a trailing edge guide rail rib spanning the cavity, and a plurality of apertures therethrough; and an impingement rib insertable into said guide channel.

2. The impingement rib assembly of claim 1, wherein said impingement rib comprises a plurality of apertures therethrough; said apertures of said impingement rib being in registration with said apertures in said guide channel.

3. The impingement rib assembly of claim 1, wherein said impingement rib is machined from sheet metal.

4. The impingement rib assembly of claim 1, wherein said impingement rib is simply cast.

5. The impingement rib assembly of claim 4, wherein said impingement rib comprises a plurality of apertures that are subsequently machined therein.

6. The impingement rib assembly of claim 4, wherein said impingement rib comprises a plurality of cast-in apertures.

7. The impingement rib assembly of claim 1, wherein said guide channel insertion point is sealed after said impingement rib is fully assembled in said guide channel.

8. The impingement rib assembly of claim 7, wherein said impingement rib is brazed into place in said guide channel such that the sides of said leading edge guide rail rib and said trailing edge guide rail rib are sealed.

9. The impingement rib assembly of claim 7, wherein said impingement rib floats freely in said guide channel to allow for pressurized sealing against one of said guide rail ribs after said guide channel is sealed.

10. The impingement rib assembly of claim 1, further comprising a tab at an inner diameter or an outer diameter of said guide channel insertion point.

11. The impingement rib assembly of claim 1, further comprising pedestals in adjacent cavities of said airfoil.

12. The impingement rib assembly of claim 1, wherein said guide channel comprises a tapered profile such that said impingement rib may be press fitted into said guide channel.

13. The impingement rib assembly of claim 1, wherein the impingement rib spans the cavity.

14. The impingement rib assembly of claim 1, wherein the impingement rib contacts the suction side wall and the pressure side wall.

15. The impingement rib assembly of claim 1, wherein the leading edge guide rail rib is closer to the leading edge than the impingement rib.

16. A gas engine turbine vane casting configuration which comprises:

a turbine vane;

an airfoil portion of said turbine vane having an inner cavity;

a guide, channel inside of said airfoil portion established between guide rail ribs that bisect the inner cavity; and an insertable impingement rib that is receivable into said guide channel.

17. The casting configuration of claim 16, wherein said guide channel comprises a plurality of apertures therethrough.

18. The casting configuration of claim 17, wherein said impingement rib comprises a plurality of apertures therethrough; said plurality of apertures being in registration with said plurality of apertures of said guide channel.

19. The casting configuration of claim 16, wherein said guide channel has an insertion point that is sealed once said impingement rib is assembled in said guide channel.

20. The casting configuration of claim 16, wherein said impingement rib is brazed into place in said guide channel.

21. The casting configuration of claim 16, wherein said impingement rib floats freely in said guide channel.

22. The impingement rib assembly of claim 16, wherein the guide rail ribs bisect the bisected portions of the inner cavity are not equally sized.

* * * * *